US009095968B2

(12) United States Patent
Kahra

(10) Patent No.: US 9,095,968 B2
(45) Date of Patent: Aug. 4, 2015

(54) TOOL FOR BREAKING HAMMER, BREAKING HAMMER, AND USE THEREOF

(75) Inventor: Ossi Kahra, Tampere (FI)

(73) Assignee: SANDVIK MINING & CONSTRUCTION OY, Tampere (FI)

( * ) Notice: Subject to any disclaimer, the term of this patent is extended or adjusted under 35 U.S.C. 154(b) by 0 days.

(21) Appl. No.: 14/344,951

(22) PCT Filed: Sep. 12, 2012

(86) PCT No.: PCT/FI2012/050881

§ 371 (c)(1), (2), (4) Date: Mar. 14, 2014

(87) PCT Pub. No.: WO2013/038059

PCT Pub. Date: Mar. 21, 2013

(65) Prior Publication Data

US 2014/0346840 A1 Nov. 27, 2014

(30) Foreign Application Priority Data

Sep. 15, 2011 (FI) ..... 20115904

(51) Int. Cl.

| | |
|---|---|
| ***B25D 17/02*** | (2006.01) |
| ***B28D 1/26*** | (2006.01) |
| ***B28D 1/28*** | (2006.01) |
| ***E02F 3/96*** | (2006.01) |
| ***B25D 9/12*** | (2006.01) |
| ***E21C 27/28*** | (2006.01) |
| ***E21D 9/10*** | (2006.01) |

(52) U.S. Cl.

CPC ..... *B25D 17/02* (2013.01); *B25D 9/125* (2013.01); *B28D 1/26* (2013.01); *B28D 1/28* (2013.01); *E02F 3/966* (2013.01); *E21C 27/28* (2013.01); *E21D 9/106* (2013.01); *B25D 2217/0007* (2013.01)

(58) Field of Classification Search

CPC ..... B25D 2217/0007; B25D 17/02

See application file for complete search history.

(56) References Cited

U.S. PATENT DOCUMENTS

| | | | | |
|---|---|---|---|---|
| 1,627,435 | A * | 5/1927 | Hooben | 81/176.1 |
| 3,108,644 | A | 10/1963 | Gnstafson | |
| 3,866,690 | A * | 2/1975 | Lance et al. | 173/15 |
| 3,868,145 | A * | 2/1975 | Cobb et al. | 299/37.5 |
| 5,183,316 | A | 2/1993 | Ottestad | |
| 7,984,703 | B2 | 7/2011 | Hiraga | |

FOREIGN PATENT DOCUMENTS

| | | | |
|---|---|---|---|
| CN | 101195215 | A | 6/2008 |
| DE | 3526162 | A1 | 1/1987 |
| EP | 0089140 | B1 | 8/1987 |
| EP | 1604785 | A2 | 12/2005 |
| GB | 24120 | | 0/1913 |
| GB | 1402181 | | 8/1975 |

(Continued)

*Primary Examiner* — John Kreck

(74) *Attorney, Agent, or Firm* — Corinne R. Gorski

(57) ABSTRACT

The invention relates to a tool for a breaking hammer, a breaking hammer, and the use of a breaking hammer. The breaking hammer includes a percussion device, the percussion piston of which providing impacts to the tool for breaking rock. An impact surface of the tool has a curved form surface that has a radius of curvature and a center axis on the longitudinal axis of the tool. The direction of the centre axis is transverse to the plane through the longitudinal axis of the boom of a work machine.

9 Claims, 6 Drawing Sheets

(56) References Cited

FOREIGN PATENT DOCUMENTS

| | | | | |
|---|---|---|---|---|
| JP | 48-102365 | A | | 12/1973 |
| JP | 60172681 | | | 11/1985 |
| JP | 60172681 | U | | 11/1985 |
| JP | 2005349480 | A | | 12/2005 |
| JP | 2008142885 | A | | 6/2008 |
| RU | 2015872 | | * | 7/1994 |
| RU | 2015872 | C1 | | 7/1994 |
| WO | 2008123255 | A1 | | 10/2008 |

* cited by examiner

TOOL FOR BREAKING HAMMER, BREAKING HAMMER, AND USE THEREOF

RELATED APPLICATION DATA

This application is a §371 National Stage Application of PCT International Application No. PCT/FI2012/050881 filed Sep. 12, 2012 claiming priority of FI Application No. 20115904, filed Sep. 15, 2011.

BACKGROUND OF THE INVENTION

The invention relates to a tool used in a breaking hammer. The tool has an impact surface, on which impact pulses can be provided with a percussion device of the breaking hammer. At the opposite end of the tool, there is a tip that under the influence of the impacts penetrates rock and breaks it. Further, the tool has fastening surfaces for fastening to the breaking hammer.

The invention further relates to a breaking hammer and its use. The field of the invention is described in more detail in the preambles of the independent claims of the patent application.

A breaking hammer is typically used as an attachment device in an excavator or another work machine when the intention is to break rock, concrete or some other relatively hard material, for instance. The breaking hammer has a percussion device, with which impacts can be provided to a tool that is fastened to the breaking hammer and transmits the impact pulses to the material to be broken. The percussion device has a percussion piston that makes a reciprocating motion and hits an impact surface at the top end of the tool. At the same time as impacts are provided with the percussion piston, the tool is pressed against the material to be broken, and the tool penetrates into the material to be broken under the influence of the impact and pressing and breaks it. Generally, the breaking hammer is used in the upright position, when breaking boulders and ground crust. The tool of the breaking hammer is supported by bearing bushings to the body of the breaking hammer. Bearing bushings wear in use, as a result of which an angle error forms between the percussion piston and tool over time. As a result of this angle error, the impact surfaces of the percussion piston and tool may damage during percussion operation.

BRIEF DESCRIPTION OF THE INVENTION

It is an object of the present invention to provide a novel and improved tool for a breaking hammer, a breaking hammer, and its use.

The tool of the invention is characterised in that the impact surface of the tool comprises at least one curved form surface with curvature on one plane only, whereby it differs from a spherical surface.

The breaking hammer of the invention is characterised in that an impact surface of the tool comprises at least one curved form surface with curvature on one plane only, whereby it differs from a spherical surface.

The use of the invention is characterised by using the breaking hammer for excavating a rock cavern; by using the breaking hammer in the horizontal position; and by providing with the percussion piston of the breaking hammer impacts on the curved impact surface on the tool.

The idea is that the impact surface of the tool has one or more curved form surfaces capable of receiving impacts from the percussion piston. In addition, the curvature of the form surface is on one plane only. Thus, the form surface has directional curvature that differs from a spherical form surface, for example.

One advantage is that due to the curved form surface of the tool, the strength of the percussion piston impact surface can be substantially improved in situations, in which so-called oblique impacts are directed to the tool. The curved shape prevents edge contacts from forming between the percussion piston and the impact surfaces of the tool. The curved shape of the impact surface of the tool allows for a larger contact surface area between impact surfaces, whereby the strains directed to them can be controlled without needing to restrict the impact energy to improve strength. When a plane surface is arranged against such a form surface, a linear contact is established between the directional curved form surface and plane surface, whereas a point-form contact is formed between a form surface curved on several planes, such as a spherical surface, and a plane surface. Therefore, it is clear that with a form surface having directional curvature, a larger contact surface area is obtained between the impact components, which naturally improves the strength of the impact surfaces. In addition, the curved form surface allows an angle error to form between the longitudinal axes of the percussion piston and tool during use, whereby the service life of the breaking hammer may be long and its reliability good. The curved impact surface of the tool protects the impact surface of the percussion piston and may, in a manner of speaking, sacrifice itself for the percussion piston. A slow deformation of the impact surface of the tool does not cause a significant disadvantage, because due to the wear of their tip parts the tools need to be replaced much more often than the percussion pistons.

The idea of an embodiment is that the impact surface of the tool is made curved so that it is essentially in the form of a cylinder segment. The centre axis of a curved surface may be on the centre line of the tool. The size of the radius of curvature defines the curvature of the impact surface. A cylinder segment is curved on one plane only, so it differs from the spherical form that is curved on several planes.

The idea of an embodiment is that the radius of curvature of the cylindrical form shape of the impact surface is larger than the length of the tool. The curvature of the cylinder segment is then relatively small. Due to the small curvature, stress directed to the impact surface can be maintained at a reasonable level.

The idea of an embodiment is that the outer surface of the shaft between the tool ends has at least one fastening recess that is located on the section of one end of the tool, at a distance from the impact surface. The fastening recess comprises a plane surface with length in the axial direction of the tool. The direction of the centre axis of the cylinder segment of the tool impact surface is parallel to said plane surface. A fastening surface defines the position of the tool in relation to the body of the breaking hammer.

The idea of an embodiment is that a directional curved form surface has two or more radii of curvature.

The idea of an embodiment is that the directional curved form surface has several different curvatures that connect smoothly to each other, whereby the curvature may be a surface defined by a function.

The idea of an embodiment is that the impact surface of the tool has a plane surface on its outermost axial section. The plane surface is perpendicular to the longitudinal axis of the tool. The section between the outermost edge of the impact surface and said plane surface has curved form surfaces. The size of the plane surface may be relatively small in comparison with the total surface area of the impact surface. Further, the section of the outermost edge of the impact surface may have a bevel, whereby, as seen from the edge of the tool, the impact surface comprises a bevel, one or more curved sections, and a plane surface.

The idea of an embodiment is that the outermost edge of the impact surface of the tool has a bevel. This bevel may serve as a surface guiding and centering the top end of the tool.

The idea of an embodiment is that the percussion device is hydraulic.

The idea of an embodiment is that the percussion device is electric.

The idea of an embodiment is that the impact end of the percussion piston has a spherical form surface.

The idea of an embodiment is that between the longitudinal axis of the tool and the longitudinal axis of the percussion piston, a larger angle error is allowed in the direction of the vertical plane running through the longitudinal axis of the boom than in other directions.

BRIEF DESCRIPTION OF THE FIGURES

Some embodiments will be explained in more detail in the attached drawings, in which.

In the figures, some embodiments are shown in a simplified manner for the sake of clarity. Like reference numerals refer to like parts in the figures.

DETAILED DESCRIPTION OF SOME EMBODIMENTS

Figure 1:
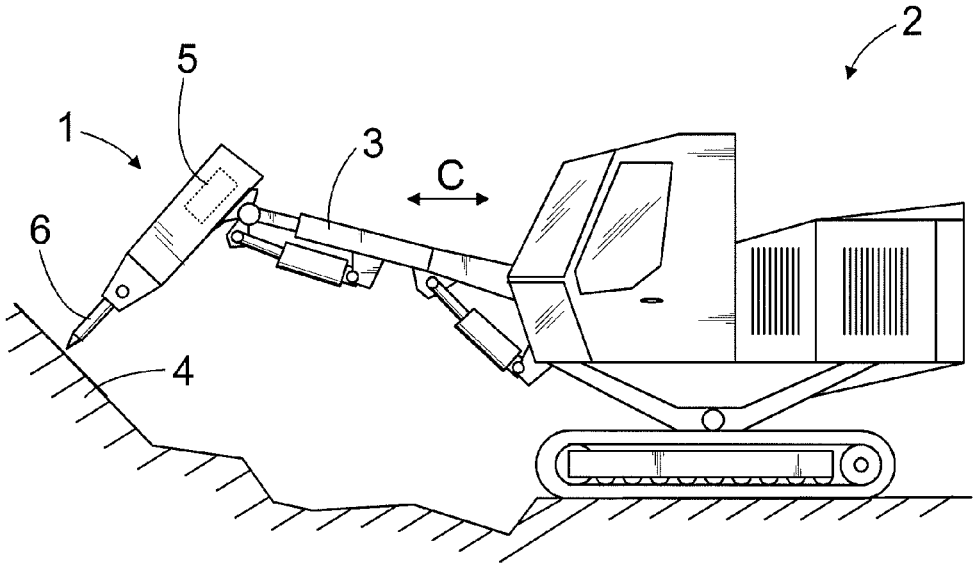
PRIOR ART FIG. 1
FIG. 1 is a schematic representation of an excavator equipped with a breaking hammer.

In FIG. 1 a breaking hammer 1 is arranged on the free end of a boom 3 of an excavator 3. The breaking hammer 1 is pressed by means of the boom 3 against material 4 to be broken and impacts are simultaneously generated with the percussion device 5 on the hammer to a tool 6 connected to the breaking hammer 1, which transmits the impact pulses to the material to be broken. Instead of an excavator 2, the breaking hammer 1 may be arranged on any movable basic machine. FIG. 1 shows the conventional use of the breaking hammer 1, in which the breaking hammer 1 is essentially in the upright position. The figure also shows the longitudinal direction C of the boom 3.

Figure 2:
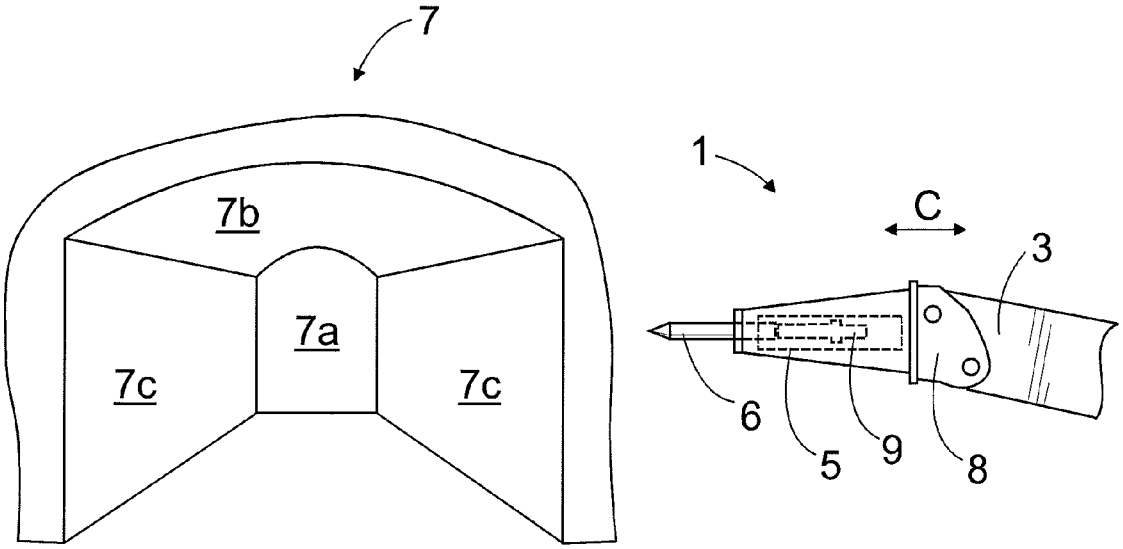
PRIOR ART FIG. 2
FIG. 2 is a schematic representation of a rock cavern and the use of a breaking hammer in excavating the rock cavern.

FIG. 2 shows a tunnel 7 that is a rock cavern that may be excavated into the rock by means of the breaking hammer 1, when the rock is a relatively soft rock. In this type of excavation, the breaking hammer 1 is positioned mainly horizontally, as illustrated in the figure. Excavation progresses in such a manner that rock is detached from the end 7*a* of the tunnel with the breaking hammer 1. Then, the ceiling 7*b* and walls 7*c* of the tunnel are made ready and finally they may also be reinforced by concreting, for instance. For excavation, the boom 3 needs to be turnable so that the breaking hammer 1 is horizontal and, if necessary, also obliquely upward and downward. The breaking hammer 1 is fastened to the boom 3 with a connecting part 8. In the figure, a dashed line marks the percussion device 5 of the breaking hammer 1 and the percussion piston 9 belonging to it.

Figure 3:
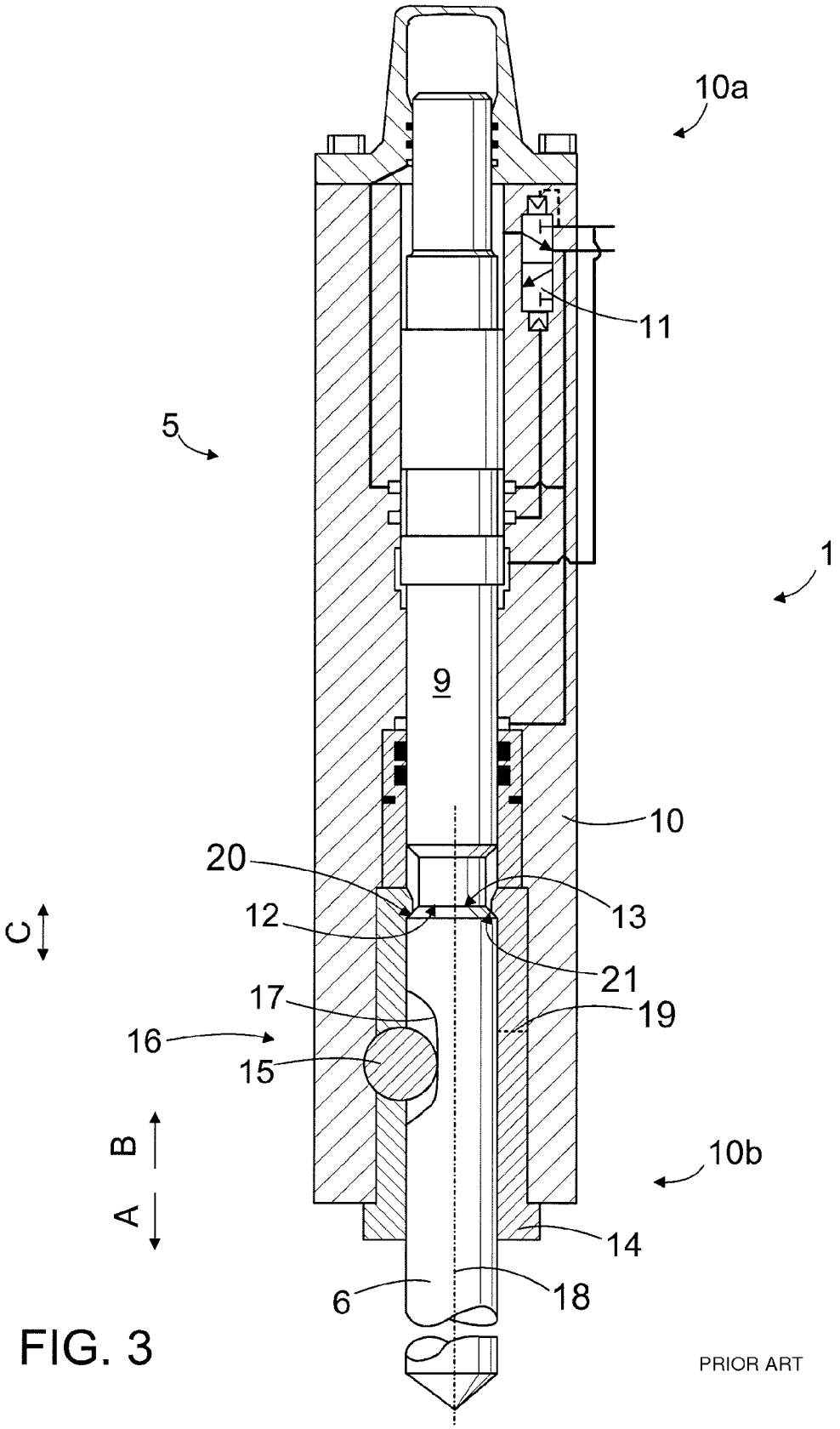
FIG. 3 PRIOR ART
FIG. 3 is a schematic cross-sectional representation of the structure of a breaking hammer.

FIG. 3 shows the structure of a breaking hammer 1. The breaking hammer 1 comprises an elongated body 10 with a top end 10*a* and a bottom end 10*b*. The tool 6 is arranged at the bottom end of the body. The body 10 may in itself form a housing protecting the breaking hammer 1 or, alternatively, a protection housing may be arranged around the body 10. A space may be formed in the body 10 for the percussion device 5 which has a percussion piston 9 movable in the impact direction A and return direction B. Further, pressure spaces with hydraulic pressure, for example, may be formed around the percussion piston 9. The percussion piston 9 may have several shoulders or other surfaces, on which the hydraulic pressure in the pressure spaces may act. Further, FIG. 3 shows a control valve 11 that may be arranged to the structure of the breaking hammer 1 or that may be a separate external component. With the control valve 11, the hydraulic pressure can be directed to act on one or more shoulders of the percussion piston 9 and, correspondingly, away from the shoulder. When the percussion piston 9 is made to move in the impact direction A, the impact surface 12 at its front end hits the impact surface 13 at the back end of the tool 6. After impact, the control valve 11 directs the percussion piston 9 to move in the return direction B, and after this, the working cycle continues as long as pressure medium is fed to the breaking hammer 1. However, it is possible that, differing from the figure, the percussion device 5 is electrically operated.

FIG. 3 also shows an embodiment of the structure of the bottom end 10*b* of the breaking hammer 1. The tool 6 may be supported to the body 10 by means of a bearing bushing 14. The tool 6 and bearing bushing 14 may be locked to the bottom end 10*b* of the body by means of a retainer pin 15 or the like. In addition, the fastening members 16 of the tool 6 may include fastening surfaces 17 on the shaft part of the tool 6, which allow the tool 6 to move in the axial direction to a predetermined distance. Differing from FIG. 3, the fastening members 16 may be arranged on both sides of the tool 6. The fastening members 16 fasten the tool 6 to the body 10 in the axial direction. In addition, the fastening members 16 prevent the rotation of the tool 6 about its longitudinal axis 18, whereby the fastening members 16 define the position of the tool 6. Differing from FIG. 3, it is possible to use two bearing bushings, namely bottom and top bearings, instead of one bearing bushing 14. A dashed line 19 in FIG. 3 illustrates this. Further, FIG. 3 shows that there may be a bevel 20 or a corresponding conical surface at the top end of the tool 6, and there may be a corresponding conical control surface 21 on the top part of the bearing bushing 14 or top bearing, whereby the top end of the tool 6 is directed to a predetermined impact position.

Figure 4:
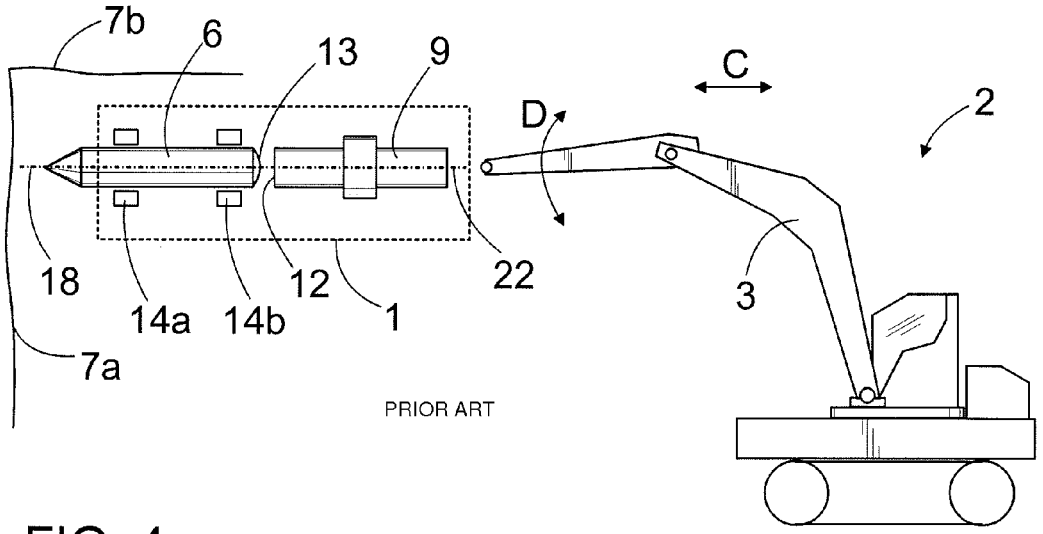
FIG. 4 is a schematic side representation of the relative positioning of a tool, percussion piston and boom in tunnelling.

FIG. 4 shows in a highly simplified manner and by using exaggerated scale the use of the breaking hammer 1 in tunnelling. The breaking hammer 1 is then used mainly horizontally, because excavation progresses in the direction of the tunnel line and the breaking hammer 1 is used to detach rock from the end 7*a*, ceiling 7*b* and walls. The tool 6 of the breaking hammer is then also horizontal, whereby its bearings wear unevenly. During excavation, the boom 3 is moved in the up-and-down direction D, which causes transverse load to the tool 6 that wears the bearings of the tool. Often operators also wedge and wrench with the tool 6 the rock being broken, which wears the bearings. Gravity also affects the directional wear of the bearings. So that the transmission of the impact pulses from the percussion piston 9 to the tool 6 would cause as little load as possible to the impact surfaces 12 and 13, the aim is to arrange the longitudinal axis 22 of the percussion piston and the longitudinal axis 18 of the tool to be parallel. However, due to manufacturing tolerances and wear, the longitudinal axes 18, 22 are rarely fully parallel, which may cause heavy loads to the impact surfaces 12, 13. A so-called edge contact may cause deformation of the impact end of the percussion piston 9 and even detachment of pieces from the edge of the impact surface 12. A damaged percussion piston 9 may be a safety risk, and it may even jam the percussion piston and prevent the normal operation of the breaking hammer 1. One difficulty is that detecting damage in the percussion piston 9 is hard, since the end of the percussion piston 9 is invisible inside the body. Another difficulty is that replacing the percussion piston 9 requires the dismantling of the structure of the breaking hammer 1 and stops excavation for the duration of the repair work.

Figure 5:
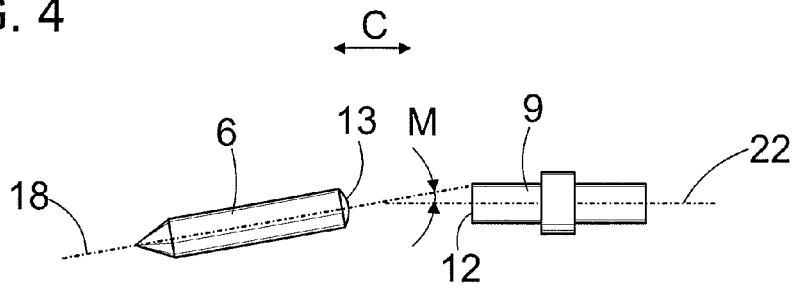
FIG. 5 is a schematic side representation of a situation, in which angle error exists between the longitudinal axes of a tool and percussion piston.

FIG. 5 illustrates in a highly simplified manner a situation, in which the longitudinal axis 18 of the tool and the longitudinal axis 22 of the percussion piston are not on the same line, but there is an angle error M between them. This angle error M may be due to designed usage clearances between the bearing bushings 14*a*, 14*b* and tool 6 and, further, due to the wear of the bearing bushings 14*a*, 14*b* in use. Typically, the front bearing 14*a* wears at its bottom edge and the back bearing 14*b* at its top edge, in which case the tool 6 may turn in relation to the bearings. To compensate for the adverse effect of the angle error M, a curved form surface in the shape of a cylinder segment is formed on the impact surface 13 of the tool 6. Owing to such a cylindrical form surface, it is possible to avoid the edge contact of the impact surface 12 of the percussion piston 9 and the loads caused thereby. The contact surface area between the impact surfaces 12 and 13 may now be larger. The impact surface 12 of the percussion piston 9 may be planar or slightly spherical.

Figure 6:
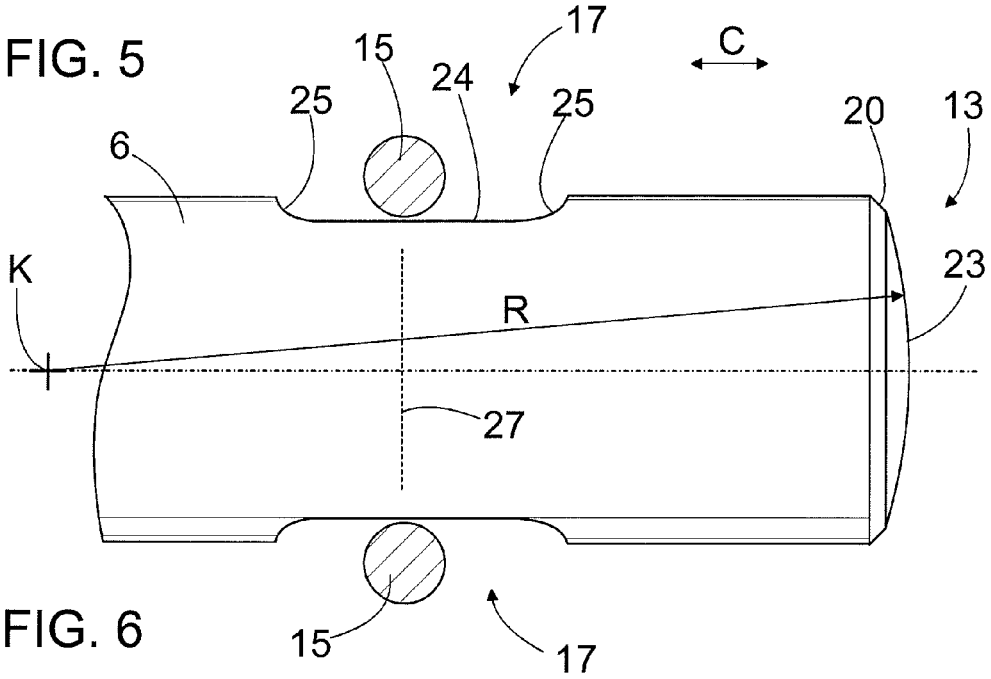
FIG. 6 is a schematic side representation of the impact end of a tunnel tool.

FIG. 6 shows a detail of the impact end of a tool 6. The impact surface 13 has a curved cylindrical form surface 23 having a radius of curvature R that defines the curvature of the form surface 23. The curvature is dimensioned to be relatively small, that is, the radius of curvature is selected to be big. The centre axis K of the form surface 23 is on the longitudinal axis 18 of the tool and its direction is transverse to the vertical plane through the longitudinal axis C of the boom. The form surface 23 is curved only in relation to the centre axis K and in no other directions. Thus, the form surface 23 has directional curvature that differs from spherical curvature, for example.

FIG. 6 shows yet another embodiment of the tool fastening surfaces 17 that may be formed on opposite sides and in the same axial location of the shaft of the tool. The fastening surfaces 17 are recesses with planar sections 24 and curved edges 25.

Figure 7:
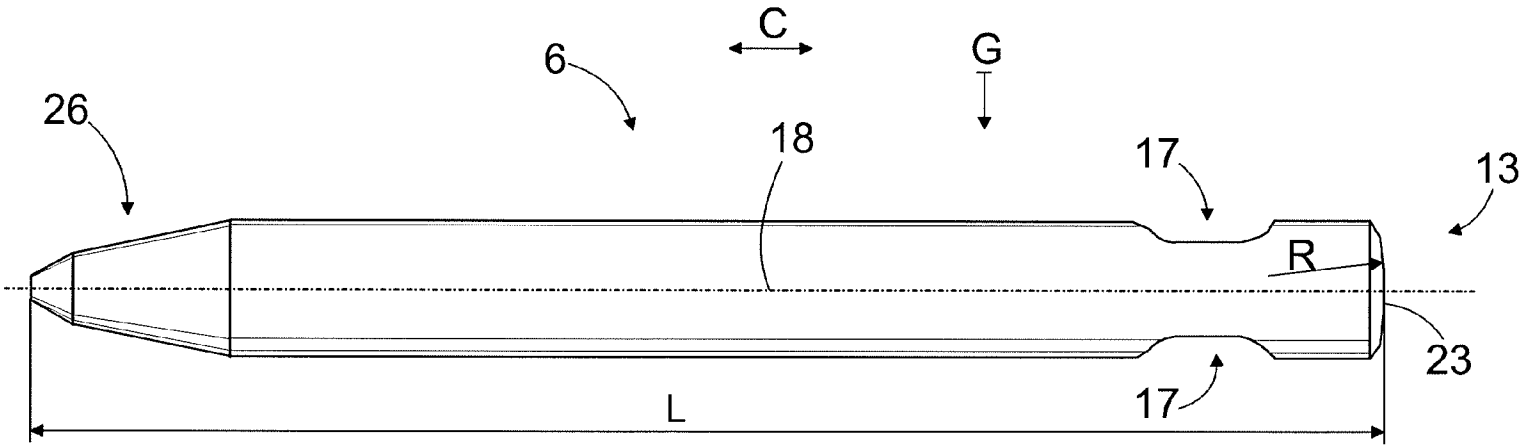
FIG. 7 is a schematic side representation of a tool.
Figure 8:
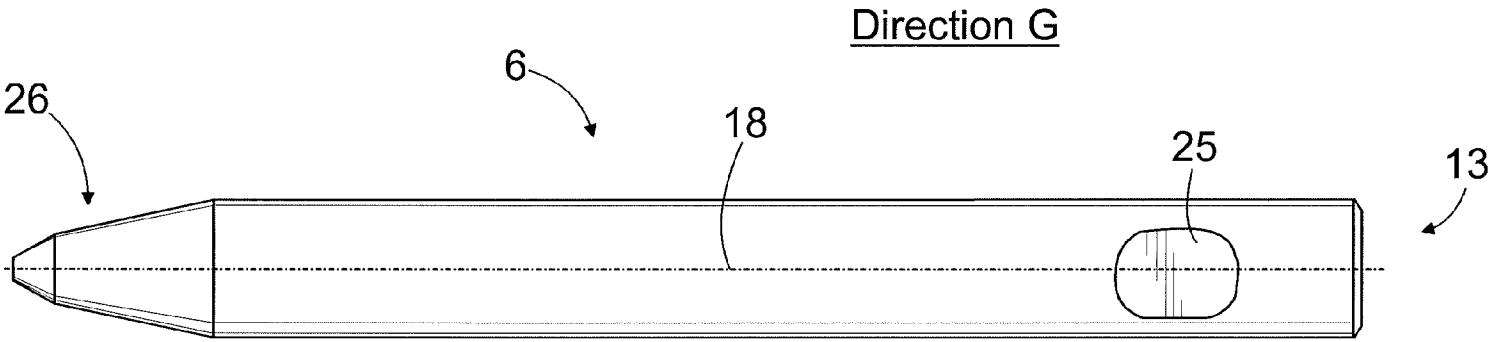
FIG. 8 is a schematic representation of the tool of FIG. 7 as seen from direction G.

FIG. 7 shows a tool from the side and FIG. 8 shows the same tool as seen from direction G. The tool 6 has an axial-direction length L and a tip 26 at its first end for breaking rock. The tip 26 may be conical or chisel-like depending on the excavation work to be done. By examining FIGS. 7 and 8, it can be seen that the impact surface 13 has a curved form surface 23 in just one direction.

It should be noted that, differing from FIGS. 6 to 8, the direction of the retainer pin 15 may be perpendicular to the direction shown in the figures, in which case the fastening surfaces 17 of the tool 6 are aligned correspondingly. A dashed line 27 in FIG. 6 illustrates an alternative direction of the retainer pin. Further, the fastening of the retainer pin 15 in the body of the breaking hammer is also aligned taking this into consideration. In this case, too, the fastening members of the tool define the position of the tool 6 in relation to its longitudinal axis, and the impact surface 13 of the tool has a cylindrical form surface 23 that is aligned taking into consideration the longitudinal direction of the boom. The centre axis K of the form surface 23 is transverse to the vertical plane through the longitudinal axis of the boom.

Figure 9:
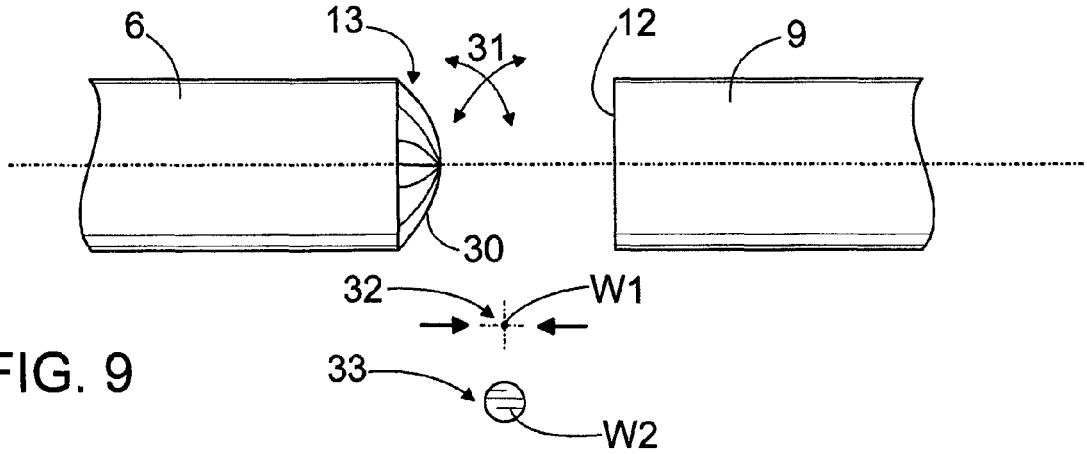
FIG. 9 is a schematic side representation of an embodiment, in which the impact surface of a tool has a spherically curved form surface, and further illustrates the effect on the contact surface area.

FIG. 9 shows the ends of the tool 6 and percussion piston 9 before impact. Differing from the invention, the tool 6 has a curved spherical form surface 30 with curvature on different planes. This is illustrated by arrows 31. The percussion piston 9 may have a planar impact surface 12. When the planar impact surface 12 meets the spherical form surface 30, there is a point-form contact 32 between them, as illustrated in the figure. However, the contact surface between the tool 6 and percussion piston 9 is compressed somewhat under the effect of the percussion forces, whereby the contact surface transforms under compression to a circular contact surface 33 and the contact surface area widens from the original surface area W1 to the surface area W2 under compression. The compression is illustrated by opposite arrows in the figure.

Figure 10:
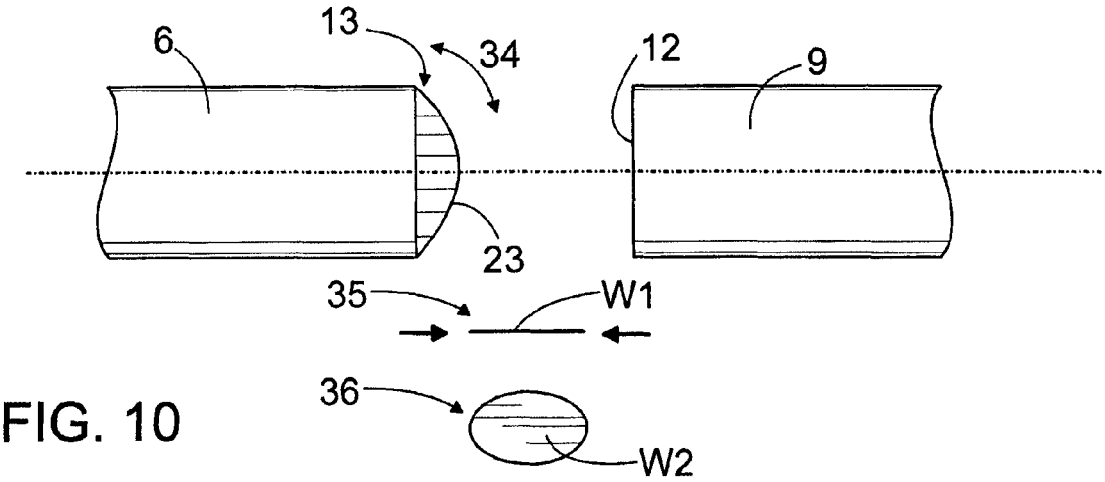
FIG. 10 is a schematic side representation of an embodiment, in which the impact surface of a tool has a directionally curved form surface, and further illustrates the effect on the contact surface area.

FIG. 10 shows a situation that otherwise corresponds to FIG. 9 except that the tool 6 has a cylindrical form surface 23 with curvature on one plane only, in this case on the vertical plane. This is illustrated by arrow 34 in the figure. Between such a directional form surface 23 and the planar impact surface 12 of the percussion piston 9, there is a linear contact 35. However, the compression force caused by the impact compresses the form surface 23 to some extent, whereby the linear form surface 35 transforms into an oval contact surface 36 having a larger surface area W2 than the original surface area W1. By comparing FIGS. 9 and 10, it is possible to detect that the directional curvature according to FIG. 10 can provide a clearly larger final surface area W2.

Figure 11A:
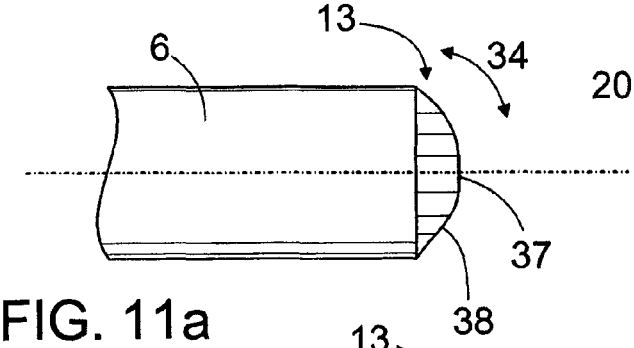
FIG. 11*a* is a schematic side representation of an embodiment, in which the impact surface of a tool has on its centre axis a plane surface, and the curved surfaces are between the plane surface and the edges.
Figure 11B:
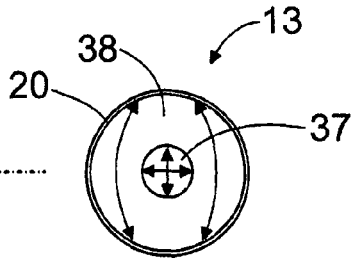
FIG. 11*b* is a schematic representation of the tool of FIG. 11*a* as seen from the direction of the percussion piston.

FIG. 11*a* shows a solution that otherwise corresponds to FIG. 10 except that the impact surface 13 of the tool 6 has a planar section 37 that is perpendicular to the longitudinal axis. This type of planar section 37 may be relatively small in comparison with the total surface area of the impact surface 13. In spite of this, the planar section 37 increases the contact surface area between the percussion piston 9 and tool 6. Between the planar section 37 and the tool 6 edge, there is a curved form surface 38, as shown in FIG. 11*b*. In FIG. 11*b*, the arrows aim to illustrate the shapes of the different sections of the impact surface 13. There may be a bevel 20 at the outermost edge. The solution according to this embodiment also permits the formation of an angle error in the tool 6 during use owing to the wear of the bearings, for example.

Figure 12:
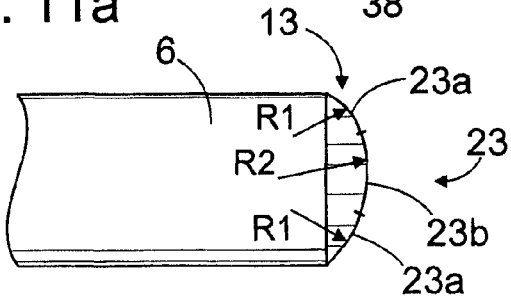
FIG. 12 is a schematic representation of yet another embodiment, in which the curved form surface on the impact surface of the tool comprises several different curvatures.

FIG. 12 shows the tool impact surface 13 that has a form surface 23 with directional curvature. The difference to the solution shown in FIG. 10, for instance, is that the form surface 23 has different curvatures, that is, it may have curved sections 23*a* with a radius of curvature R1 on the edges and a curved section 23*b* with a radius of curvature R2 in the middle. The radius of curvature R2 may be bigger than the radius R1, whereby the section 23*b* in the middle has smaller curvature. Alternatively, the curvatures may be vice versa and, further, there may be even more curved sections of different type. It is also possible that the radius of curvature R changes according to a function and produces sections of different curvatures on the form surface 23.

Figure 13:
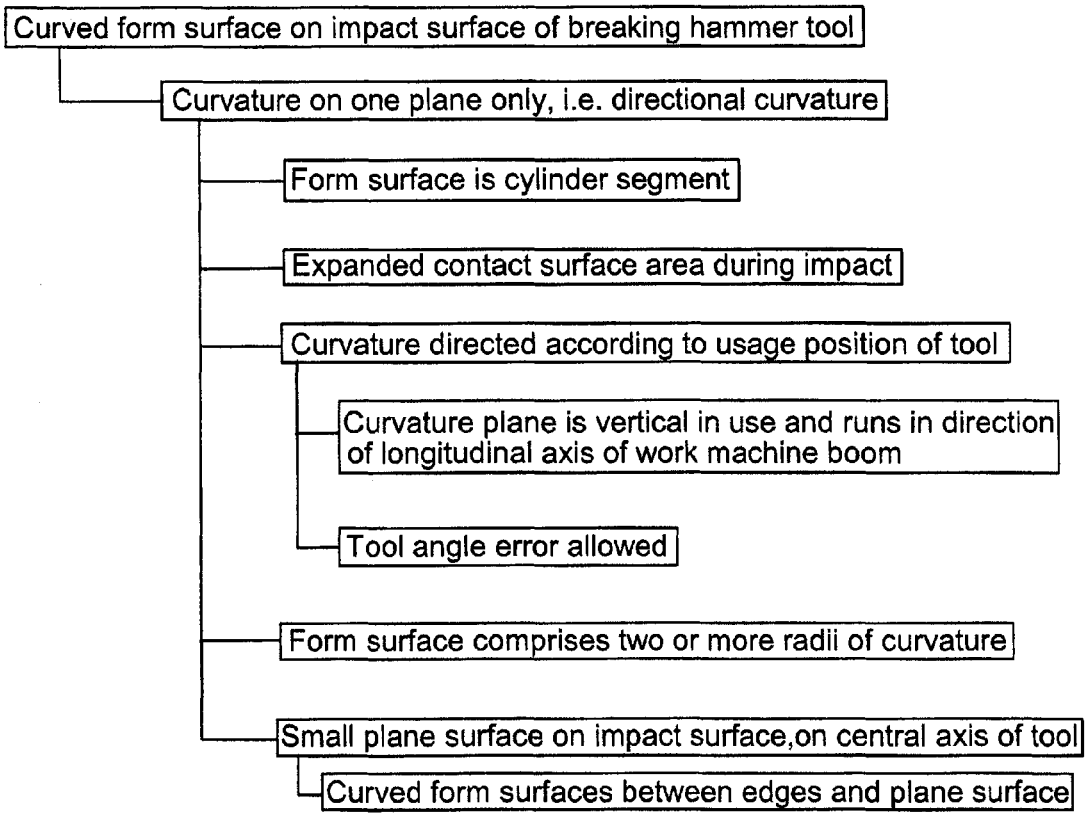
FIG. 13 is a simple diagram showing some features and ideas disclosed in this application.

FIG. 13 shows some of the above features schematically.

The tool shown in this patent application is also suitable for use in breaking hammers in which the percussion devices do not comprise a conventional reciprocating percussion piston. This type of percussion device may have a percussion element, to which a high-frequency vibration is provided by means of pressure medium or electric energy and then transmitted through the impact surface in the percussion element to the impact surface of the tool.

In some cases, features disclosed in this application may be used as such, regardless of other features. On the other hand, when necessary, features disclosed in this application may be combined in order to provide various combinations.

The drawings and the related description are only intended to illustrate the idea of the invention. Details of the invention may vary within the scope of the claims.

The invention claimed is:

1. A breaking hammer tool that is an elongated piece, the tool comprising:

a first head equipped with a tip;

a second head equipped with an impact surface arranged to receive impact pulses from a percussion piston of a breaking hammer; and at least one fastening surface, wherein the impact surface includes at least one curved form surface, the curved form surface having at least one centre axis and being curved only in relation to the at least one centre axis, wherein the curved surface differs from a spherical surface, the curved form surface having a radius of curvature that is bigger than a length of the tool.

2. A tool as claimed in claim 1, wherein the curved form surface has the shape of a cylinder segment.

3. A tool as claimed in claim 1, wherein the curved form surface has at least one radius of curvature, an outer surface of the shaft being located between ends of the tool and having at least one fastening recess that is located on a section of one end of the tool, at a distance from the impact surface, the at least one fastening recess including a plane surface, a direction of the centre axis being parallel to said plane surface.

4. A tool as claimed in claim 1, wherein an outermost edge of the impact surface has a bevel.

5. A tool as claimed in claim 1, wherein the impact surface has on an outermost axial-direction section a plane surface that is perpendicular to a longitudinal axis of the tool, a section located between the outermost edge of the impact surface and said plane surface having curved form surfaces.

6. A breaking hammer comprising:

a body;

a connection part for connecting the breaking hammer to a boom of a work machine, whereby the breaking hammer is parallel to the boom;

a percussion device including a percussion piston arranged to move back and forth between an impact direction and a return direction for generating impact pulses;

a tool located in front of the percussion piston, as seen in the impact direction, the tool including an impact surface for receiving the impact pulses of the percussion piston; and fastening members for detachably fastening the tool to the body, the fastening members permitting restricted axial movement of the tool but preventing rotation of the tool about its longitudinal axis, wherein the impact surface of the tool has at least one curved form surface having at least one centre axis, the curved form surface of the tool being curved only in relation to the at least one centre axis, whereby it wherein the at least one curved surface differs from a spherical surface, the curved form surface having a radius of curvature that is bigger than a length of the tool.

7. A breaking hammer as claimed in claim 6, wherein the curved form surface has the shape of a cylinder segment the tool being fastened to the body such that the direction of a centre axis of the cylinder segment is transverse to a vertical plane in a longitudinal direction of the boom.

8. A method of using a breaking hammer, comprising the steps of:

using the breaking hammer to excavate a rock cavern, the breaking hammer comprising a body; a connection part for connecting the breaking hammer to a boom of a work machine, wherein the breaking hammer is parallel to the boom; a percussion including a percussion piston arranged to move back and forth between an impact direction and a return direction for generating impact pulses; a tool located in front of the percussion piston, as seen in the impact direction, the tool including an impact surface for receiving the impact pulses of the percussion piston; and fastening members for detachably fastening the tool to the body, the fastening members permitting restricted axial movement of the tool but preventing rotation of the tool about its longitudinal axis, wherein the impact surface of the tool has at least one curved form surface having at least one centre axis, the curved form surface of the tool being curved only in relation to the at least one centre axis, wherein the at least one curved surface differs from a spherical surface, the curved form surface having a radius of curvature that is bigger than a length of the tool;

using the breaking hammer horizontally; and providing impacts with the percussion piston of the breaking hammer to a curved impact surface on the tool.

9. The method of using the breaking hammer as claimed in claim 8, further comprising the step of allowing, between the longitudinal axis of the tool and the longitudinal axis of the percussion piston, a larger angle error in the direction of the vertical plane through a longitudinal axis of the boom than in other directions.

* * * * *